US006780089B2

(12) United States Patent
Pan et al.

(10) Patent No.: US 6,780,089 B2
(45) Date of Patent: Aug. 24, 2004

(54) METHOD AND APPARATUS FOR REMOVING A PREDETERMINED AMOUNT OF MATERIAL FROM A BOTTOM PORTION OF A DOVETAIL SLOT IN GAS TURBINE ENGINE DISK

(75) Inventors: Paul Yin-Pu Pan, Cincinnati, OH (US); Gerald Roger Geverdt, Cincinnati, OH (US); Michael Jay Brunck, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 61 days.

(21) Appl. No.: 10/308,392

(22) Filed: Dec. 3, 2002

(65) Prior Publication Data

US 2004/0106359 A1 Jun. 3, 2004

(51) Int. Cl.[7] ..... B24C 7/00
(52) U.S. Cl. ..... 451/36; 451/99; 451/113
(58) Field of Search ..... 451/28, 29, 36, 451/38–40, 64, 99, 113

(56) References Cited

U.S. PATENT DOCUMENTS 4,936,057 A * 6/1990 Rhoades ..... 451/36
5,125,191 A * 6/1992 Rhoades ..... 451/36
5,341,602 A * 8/1994 Foley ..... 451/64
6,183,347 B1 2/2001 Shaw ..... 451/36
6,464,570 B1 * 10/2002 Shaw et al. ..... 451/102

FOREIGN PATENT DOCUMENTS

EP 106507 A2 * 4/1984 ..... B24B/31/00

* cited by examiner

*Primary Examiner*—Joseph J. Hail, III
*Assistant Examiner*—David B. Thomas
(74) *Attorney, Agent, or Firm*—V. G. Ramaswamy; James P. Davidson

(57) ABSTRACT

A system and method of removing a predetermined amount of material from a bottom portion of a dovetail slot in a gas turbine engine disk, including the steps of configuring a designated flow path through the dovetail slot and providing a flow of abrasive media through the flow path a designated number of cycles so that a substantially uniform amount of material is removed from the dovetail slot bottom portion. The method also includes the step of sealing a pressure surface of the dovetail slot to prevent the abrasive media from flowing thereagainst.

23 Claims, 11 Drawing Sheets

METHOD AND APPARATUS FOR REMOVING A PREDETERMINED AMOUNT OF MATERIAL FROM A BOTTOM PORTION OF A DOVETAIL SLOT IN GAS TURBINE ENGINE DISK

BACKGROUND OF THE INVENTION

The present invention relates generally to the repair of a dovetail slot in a gas turbine engine disk and, more particularly, to an apparatus and method of removing a predetermined amount of material from a bottom portion of such dovetail slot.

It has been found that heavily cold worked material and other characteristics having the capability to reduce low cycle fatigue in dovetail slots of gas turbine engine disks, and particularly turbine disks which are rotated, may be caused during generation of such dovetail slots. In particular, the disturbed material may be caused by a dull broach tool during formation of the dovetail slot. Conventional methods of removing such disturbed material include milling the dovetail slot or to broach it again. Each of these processes, however, are useful only so long as the tools employed are sharp. Further, a hand deburr operation is typically required, which inherently involves a high risk of creating tool marks in the highly stressed dovetail area.

It is known in the art to utilize a flow of abrasive material on surfaces of gas turbine engine components in order to polish or provide surface finishing thereof. Such operations involve removing only a minimal amount of material (e.g., on the order of 0.0005 inch or 0.5 mil). An example of one such method is disclosed in U.S. Pat. No. 6,183,347 to Shaw, where a stream of pliant shot in a carrier fluid is discharged at a shallow angle of incidence against a plug and an adjoining surface for selective abrasion to provide a step. It will be appreciated therein that the method described is for the selective surface treating of a workpiece and does not involve the removal of material on the order required to remove a disturbed layer of material or shallow cracks.

While the aforementioned methods of removing disturbed material from a gas turbine engine disk are useful for that particular purpose, it would be desirable for an improved method of removing such disturbed material to be developed which overcomes the limitations noted above. It would also be desirable for an apparatus to be developed which defines a flow path through the dovetail slot in a manner which permit substantially uniform removal of the material in a surface on a bottom portion thereof without affecting the pressure surface portion of the dovetail slot.

BRIEF SUMMARY OF THE INVENTION

In a first exemplary embodiment of the invention, a method of removing a predetermined amount of material from a bottom portion of a dovetail slot in a gas turbine engine disk is disclosed as including the steps of configuring a designated flow path through the dovetail slot and providing a flow of abrasive media through the flow path for a designated number of cycles so that a substantially uniform amount of material is removed from the dovetail slot bottom portion. The method also includes the step of sealing a pressure surface of the dovetail slot to prevent the abrasive media from flowing thereagainst.

In a second exemplary embodiment of the invention, an apparatus for removing a predetermined amount of material from a bottom surface of a dovetail slot in a gas turbine engine disk is disclosed, wherein a longitudinal axis extends through the dovetail slot. The system includes a fixture for providing a flow of abrasive media back and forth through a designated path at a predetermined pressure and flow rate, a cradle for retaining the gas turbine engine disk in position so that the dovetail slot is in flow communication with the designated path, and a device for defining a designated flow path through the dovetail slot for the abrasive media. The flow of abrasive media then removes a substantially uniform amount of material from a bottom surface of the dovetail slot. The designated path of the abrasive flow fixture is configured to enable work on each dovetail slot of the disk to be performed substantially simultaneously.

DETAILED DESCRIPTION OF THE INVENTION

Figure 1:
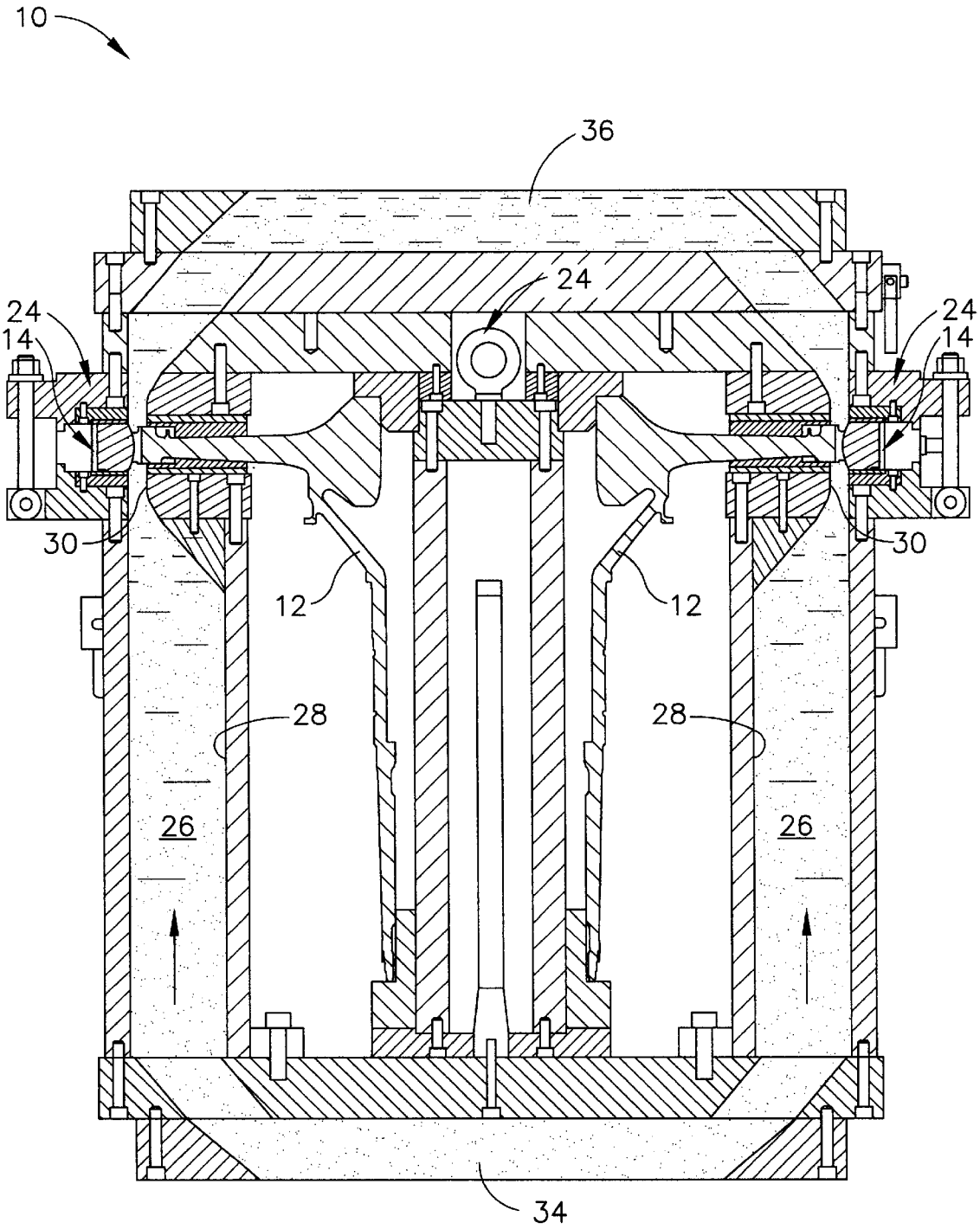
FIG. 1 is a cross-sectional view of a turbine disk positioned within an abrasive flow fixture so as to remove material along a bottom portion of the dovetail slots in accordance with the present invention.
Figure 5:
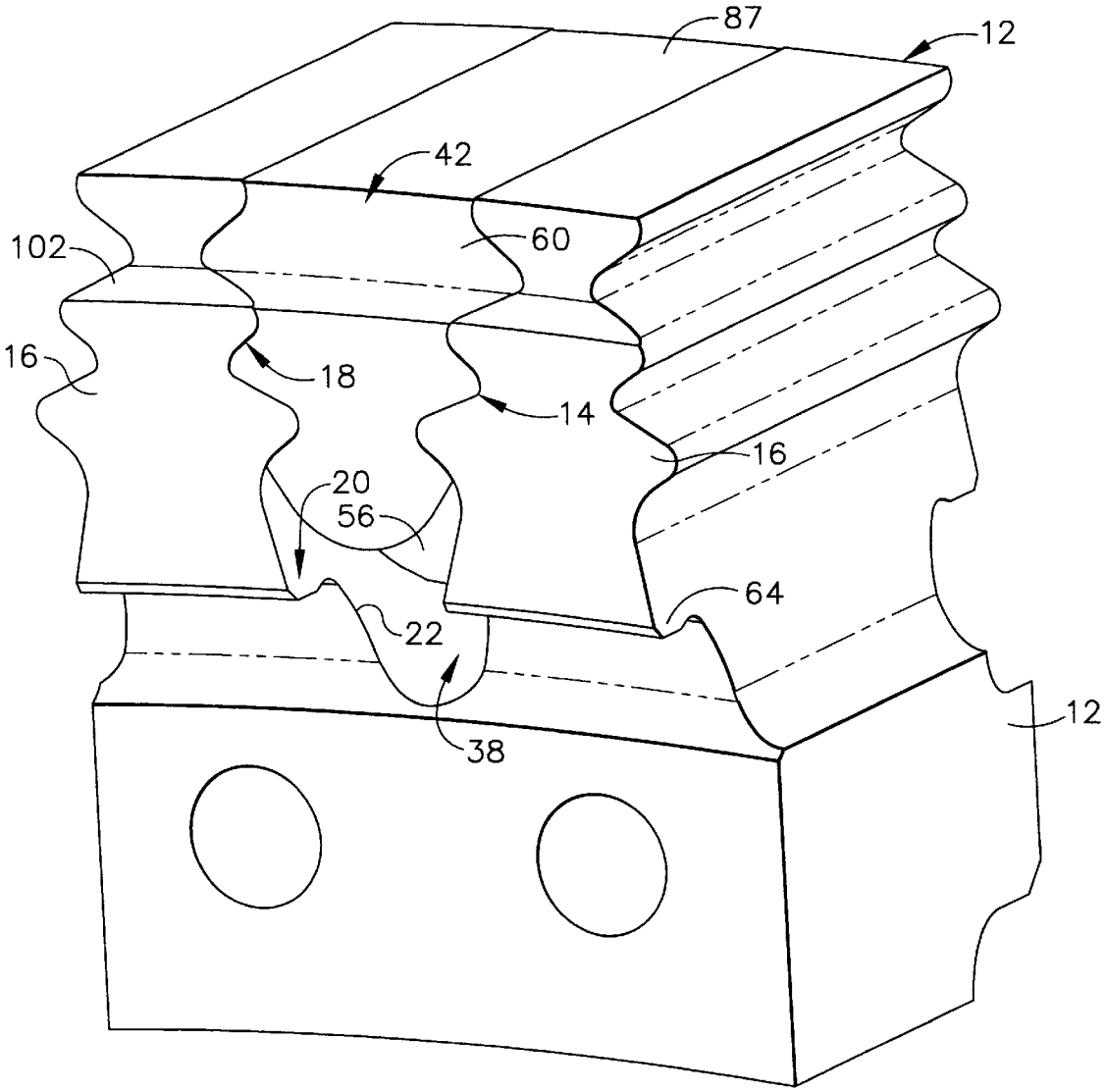
Figure 6:
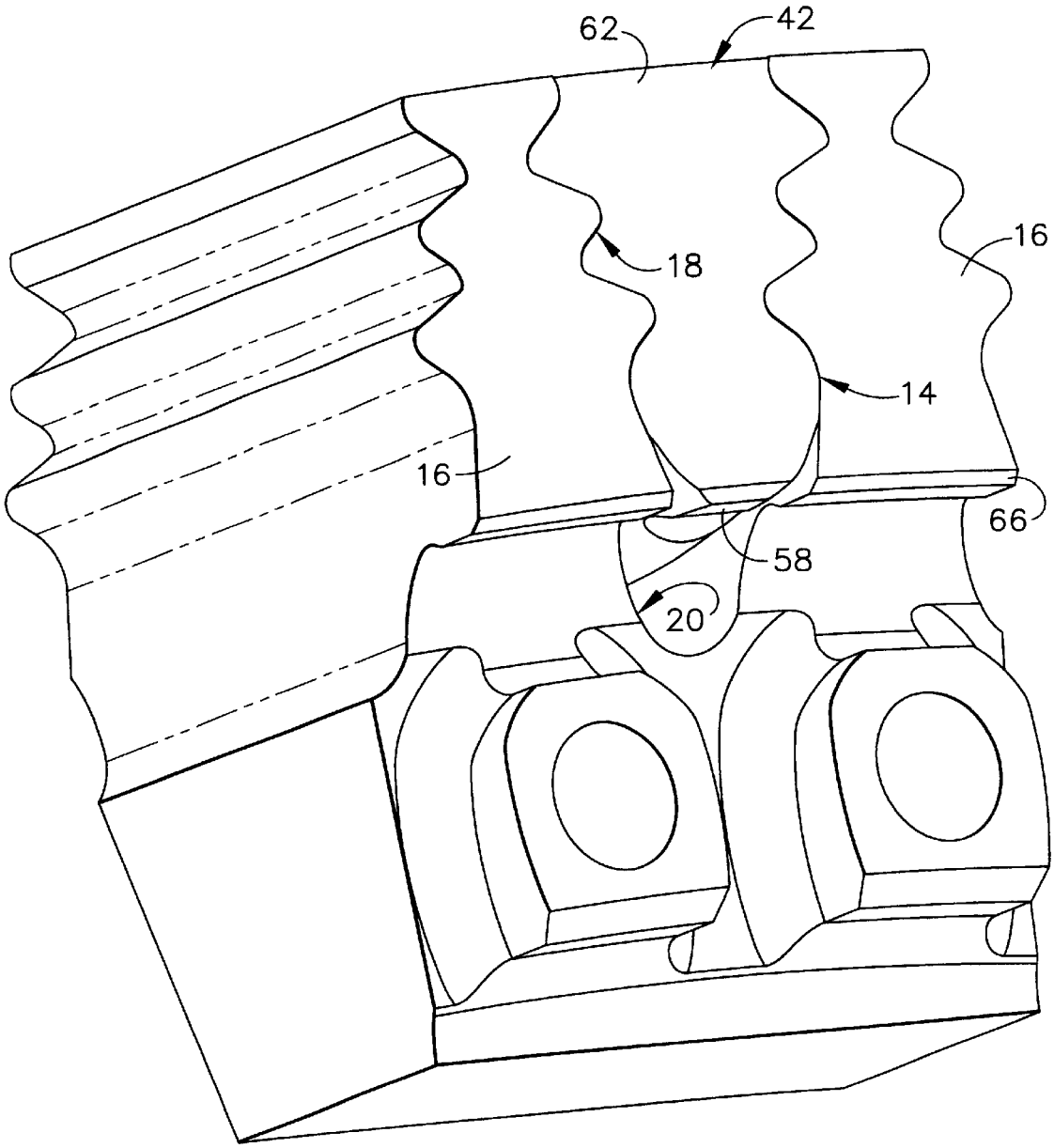
FIG. 6 is a partial aft view of the turbine disk depicted in FIG. 5.
Figure 7:
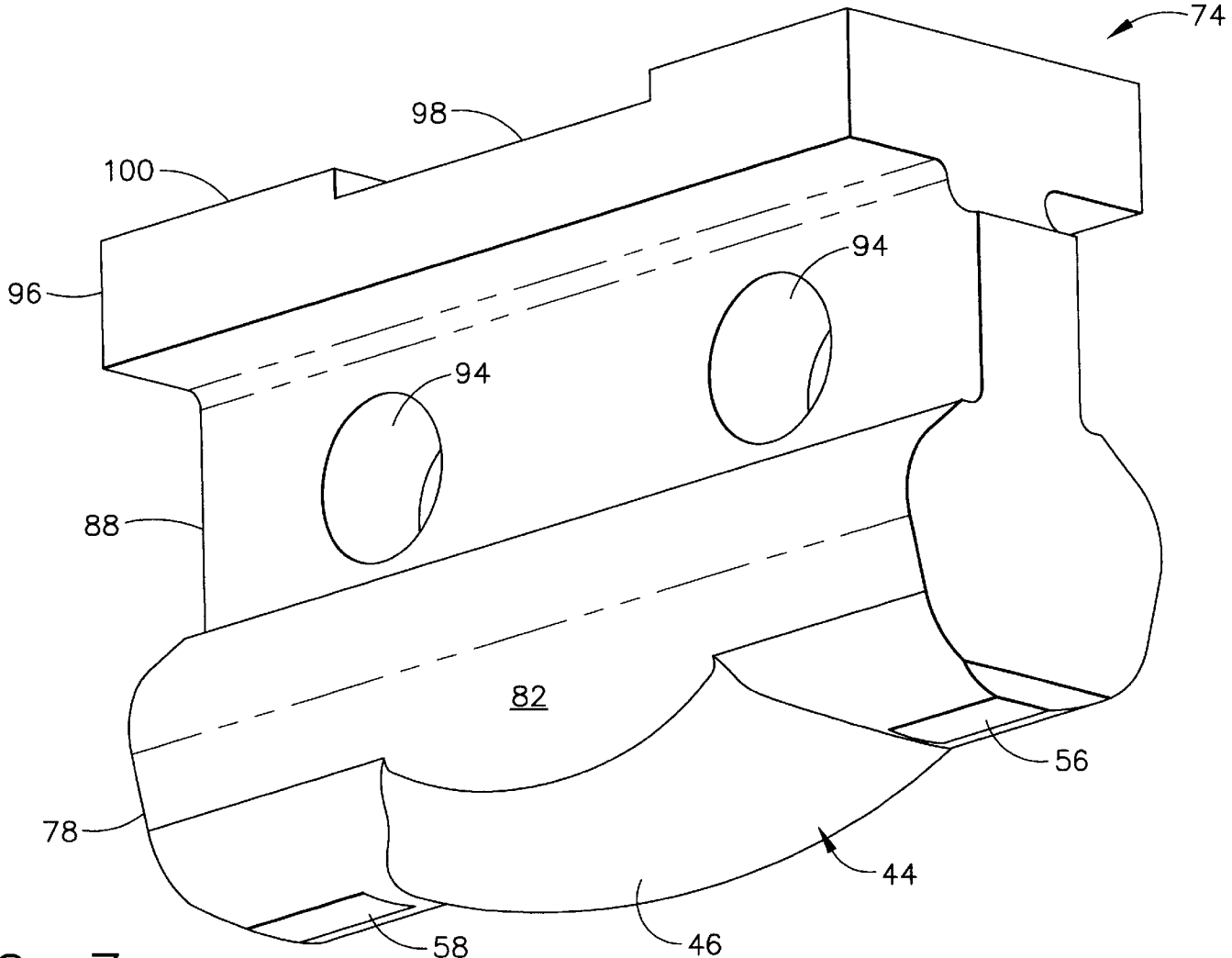
FIG. 7 is a side perspective view of the contoured pin member depicted in FIGS. 5 and 6, where an upper portion has been deleted for clarity.
Figure 9:
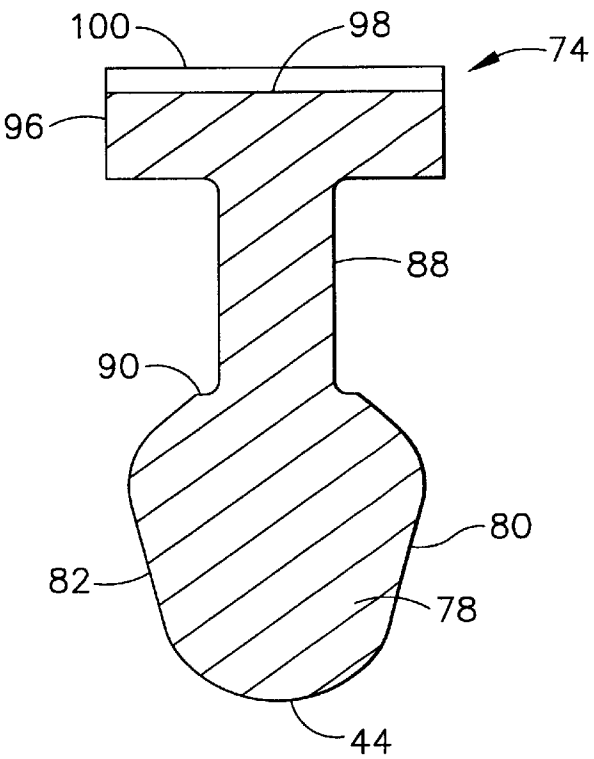
FIG. 9 is a front view of the contoured pin member depicted in FIGS. 7 and 8, where an upper portion has been deleted for clarity.
Figure 8:
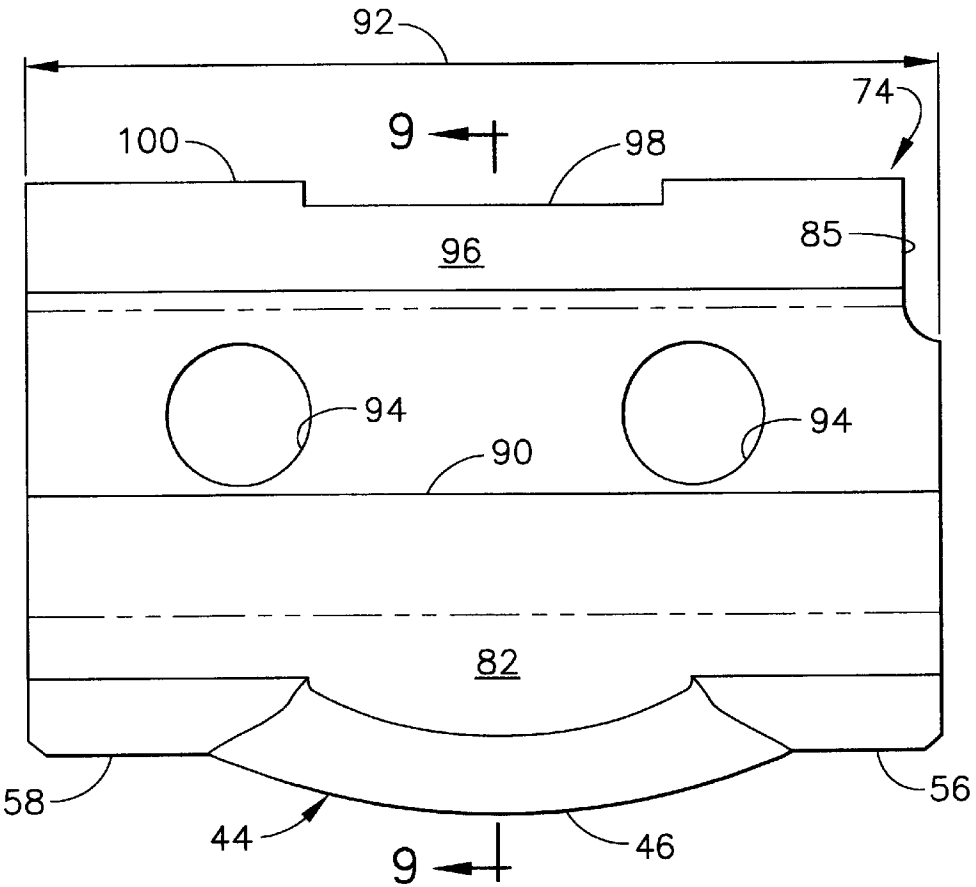
FIG. 8 is a side view of the contoured pin member depicted in FIG. 7, where an upper portion has been deleted for clarity.

Referring now to the drawings in detail, wherein identical numerals indicate the same elements throughout the figures, FIG. 1 depicts a fixture 10 for applying an abrasive flow process to a disk 12 of a gas turbine engine. An exemplary fixture is one known by the name of Spectrum, which is made by Extrudehone Corp. of Irwin, Pa. It will be understood that the abrasive flow process of the present invention may be utilized with a disk of a turbine, compressor or fan of such gas turbine engine, but that disk 12 depicted is a turbine disk. More specifically, disk 12 includes a plurality of circumferentially spaced dovetail slots 14 formed in a periphery thereof, each of which are located between adjacent posts 16 and provided to retain a turbine blade (not shown) having a complementary dovetail section therein (see FIGS. 4–6). Each dovetail slot 14 preferably has a shape generally like a fir tree and includes a pressure face portion 18 and a bottom portion 20.

In order to remove a predetermined amount of material from a surface 22 of each dovetail slot bottom portion 20, disk 12 is positioned via a cradle 24 for abrasive flow fixture 10 so that an abrasive media 26 is forced through each dovetail slot 14 as it travels through a designated path 28. It will be noted from FIG. 1 that designated path 28 of abrasive flow fixture 10 preferably is circumferential and includes a plurality of branches 30 which are in flow communication with each dovetail slot 14 so that they all may be worked substantially simultaneously. Abrasive media 26 utilized in fixture 10 includes a carrier, such as that identified as model number 995L or 649S by Extrudehone, with grit included therein preferably made of boron carbide, silicon carbide, or industrial diamond. It will be appreciated that abrasive media 26 is forced under a predetermined pressure and flow rate (preferably approximately 500–600 psi at approximately 3–5 cubic inches per second, although the pressure may be higher or lower with a corresponding decrease or increase in flow rate) from a lower portion 34 of abrasive flow fixture 10 through designated path 28, branches 30 and dovetail slots 14 into an upper portion 36 thereof by a first cylinder (not shown). Thereafter, a second cylinder (not shown) located adjacent upper portion 36 forces abrasive media 26 under the same predetermined pressure and flow rate back through designated path 28, branches 30 and dovetail slots 14 in the opposite direction to lower portion 34. It will be understood that the travel of abrasive media 26 from lower portion 34 to upper portion 36 and back to lower portion 34 constitutes one cycle as that term is utilized herein.

Figure 2:
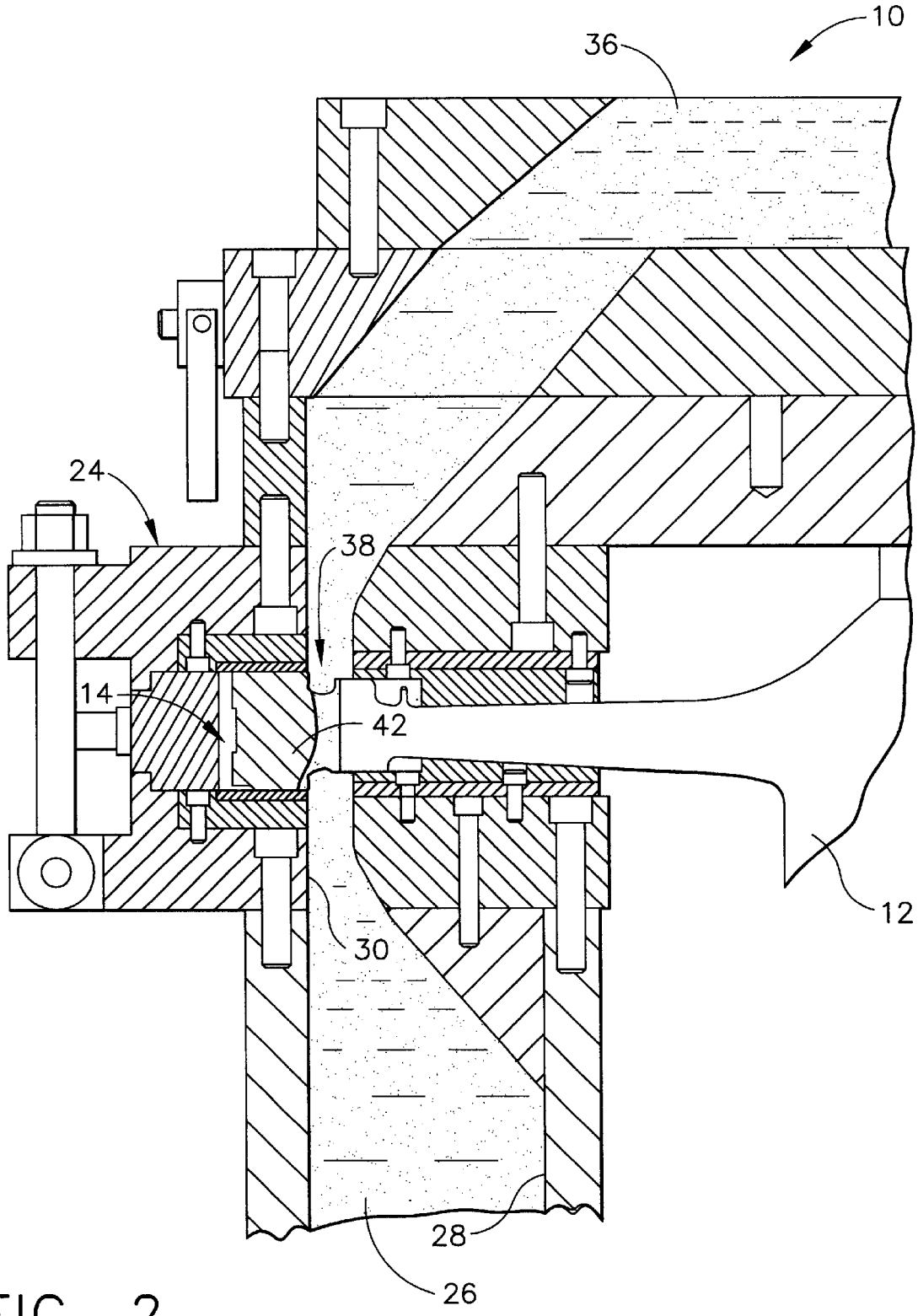
FIG. 2 is an enlarged, partial cross-sectional view of the turbine disk positioned within the abrasive flow fixture as depicted in FIG. 1.
Figure 3:
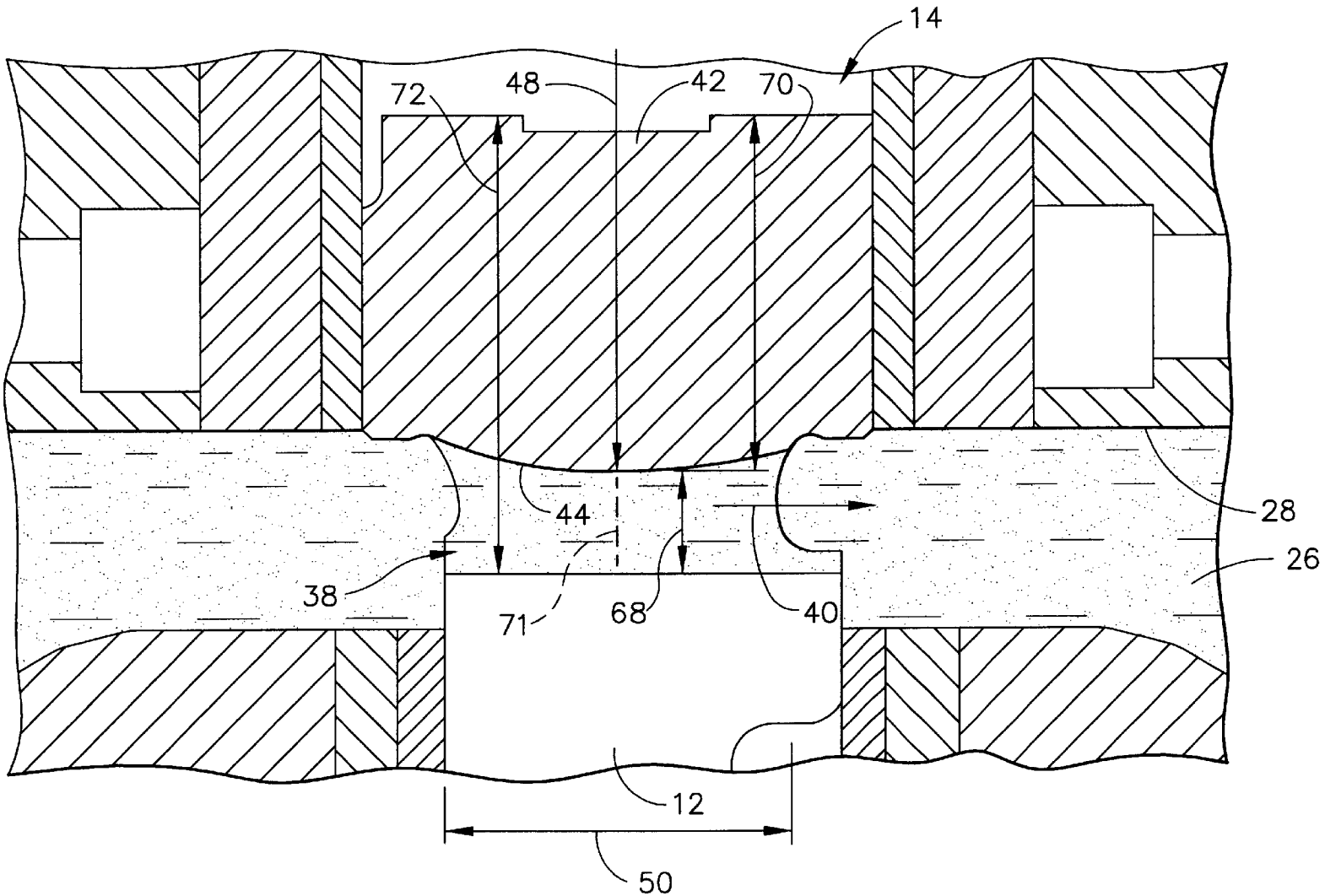
FIG. 3 is an enlarged, side view of the flow path through a bottom portion of the dovetail slot depicted in FIGS. 1 and 2.
Figure 4:
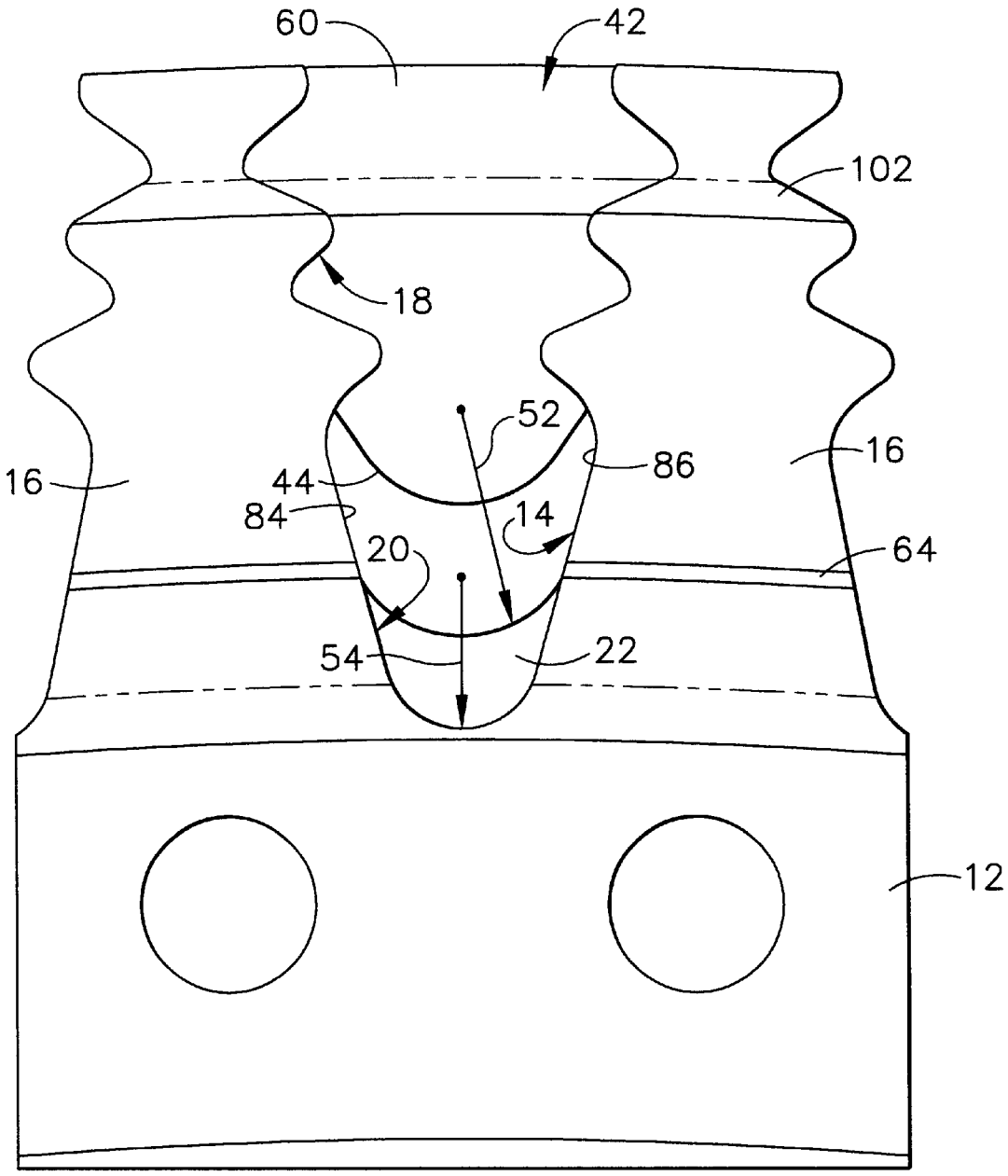
FIG. 4 is an enlarged, front view of the flow path through a bottom portion of FIG. 5 is a partial front view of a turbine disk having a contoured pin member positioned within a dovetail slot in preparation for removal of material along a bottom portion of such dovetail slot.

With respect to each dovetail slot 14, a flow path 38 having a longitudinal axis 40 (see FIG. 3) is defined through dovetail slot bottom portion 20 which is in flow communication with designated path 28 (as best seen in FIGS. 2–4). In order to define flow path 38, a device in the form of a plug or pin member 42 having certain predetermined contours is preferably positioned within each dovetail slot 14. It will be appreciated that flow path 38 does not generally have a uniform cross-section therethrough. More specifically, a bottom surface 44 of pin member 42 includes a substantially arcuate portion 46 for at least part of the axial length thereof so that a variable cross-section exists for flow path 38 along longitudinal axis 40. Arcuate portion 46 of bottom surface 44 preferably has a designated radius 48 which is proportional to a minimum axial length 50 of dovetail slot bottom portion 22. A ratio of radius 48 to minimum axial length 50 is preferably in a range of approximately 1.0–1.5 and more preferably in a range of approximately 1.2–1.4.

It will also be seen that bottom surface 44 is preferably arcuate in a circumferential direction (i.e., substantially perpendicular to longitudinal axis 40) throughout arcuate portion 46 as best seen in FIG. 4. Accordingly, a circumferential radius 52 exists which is preferably proportional to a circumferential radius 54 for surface 22 of dovetail slot bottom portion 20. A ratio of radius 52 to radius 54 is preferably in a range of approximately 1.2–1.8 and more preferably in a range of approximately 1.4–1.6.

Substantially planar portions 56 and 58 preferably exist on bottom surface 44 at a forward end 60 and an aft end 62, respectively, in order to mate with corresponding rabbets 64 and 66 formed on disk 12. Accordingly, it will be appreciated that while planar portions 56 and 58 may not have equivalent axial lengths, bottom surface 44 is substantially symmetrical thereacross. As seen in an alternate configuration depicted in FIGS. 11–14, a pin member 142 may be utilized which has a non-linear, non-symmetrical bottom surface 144 in order to have a desired amount of material removed from bottom surface 22 of dovetail bottom portion 20.

A minimum cross-section known herein as a critical gap 68 is preferably maintained in flow path 38 so as to ensure the proper flow of abrasive media 26 therethrough. Critical gap 68 may also be defined as a minimum distance between surface 22 of dovetail slot bottom portion 20 and bottom surface 44 of pin member 42 or the difference between a radial height 70 of pin member 42 and a radial height 72 of dovetail slot bottom portion 20. Critical gap 68 is generally located approximately at a midpoint 71 of flow path 38 and is approximately 50–70% of a gap width 69 at forward and aft ends 60 and 62. The corresponding cross-section of flow path 38 at midpoint 71 is therefore approximately 30–50% of the cross-section at forward and aft ends 60 and 62.

Critical gap 68 generally is a function of several parameters, including the material utilized for abrasive media 26, the predetermined pressure and flow rate at which abrasive media 26 is forced through flow path 38, and the shape of flow path 38 from both an axial and circumferential perspective. Nevertheless, it has been found for the intended process of removing material from surface 22 of dovetail slot bottom portion 20 that a ratio of radial height 70 to radial height 72 preferably be in a range of approximately 0.75–0.90 and more preferably in a range of approximately 0.80–0.86. Consequently, critical gap 68 will preferably be in a range of approximately 145–220 mils, more preferably in a range of approximately 160–210 mils, and optimally in a range of approximately 170–200 mils.

With respect to pin member 42, it will be appreciated that it more specifically includes a first portion 74 which extends into dovetail slot bottom portion 20 to define flow path 38 and a second portion 76 which is removably retained in pressure face portion 18 of dovetail slot 14. First portion 74 has a bottom section 78 which includes bottom surface 44 of pin member 42. A pair of tapered side walls 80 and 82 are part of bottom section 78 and are configured so as to avoid contact with side surfaces 84 and 86, respectively, of dovetail slot bottom portion 20. A middle section 88 extends from a top surface 90 of bottom section 78, is preferably substantially planar in configuration, and has an axial length 92. Middle section 88 also preferably includes at least one opening 94 formed therein, the purpose for which will be explained herein. It will be understood that middle section 88 may have other configurations, such as one or more cylinders extending from top surface 90 of bottom section 78.

First portion 74 further includes a top section 96 oriented substantially perpendicular to middle section 88 so that they together preferably have a substantially T-shaped cross-section. A recessed portion 98 is preferably formed in a top surface 100 of top section 96 so that a gate used in the formation process is provided. In particular, it will be understood that when first portion 74 is formed, such as by investment casting using lost wax process, a gate tail is able to be broken off easily without concern for smoothness since any remaining portion thereof lies beneath top surface 100. It will be appreciated that the material utilized for first portion 74 is preferably an air-hardened tool steel such as A2, D2 or ductile iron which is heat treated to increase wearability. Other material which may be used for first portion 74 includes cemented tungsten carbide which is molded and sintered. In any case, it is preferred that the material of first portion 74 have a hardness in a range of approximately 25–60 on the Rockwell scale so that it is able to withstand the abrasion from abrasive media 26 flowing through flow path 38.

Figure 10:
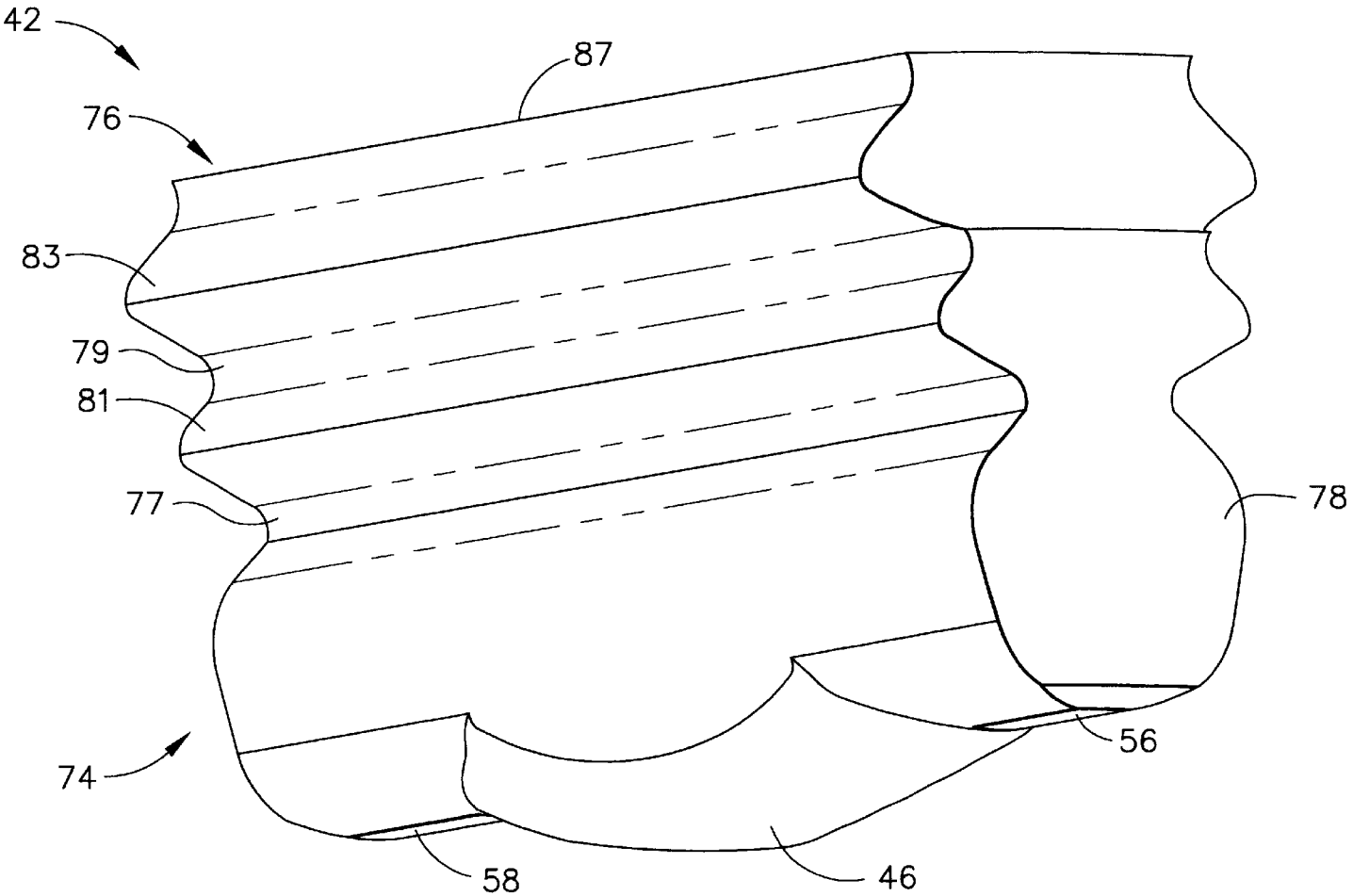
FIG. 10 is a side perspective view of the contoured pin member depicted in FIGS. 7–9 with the upper portion included thereon.
Figure 11:
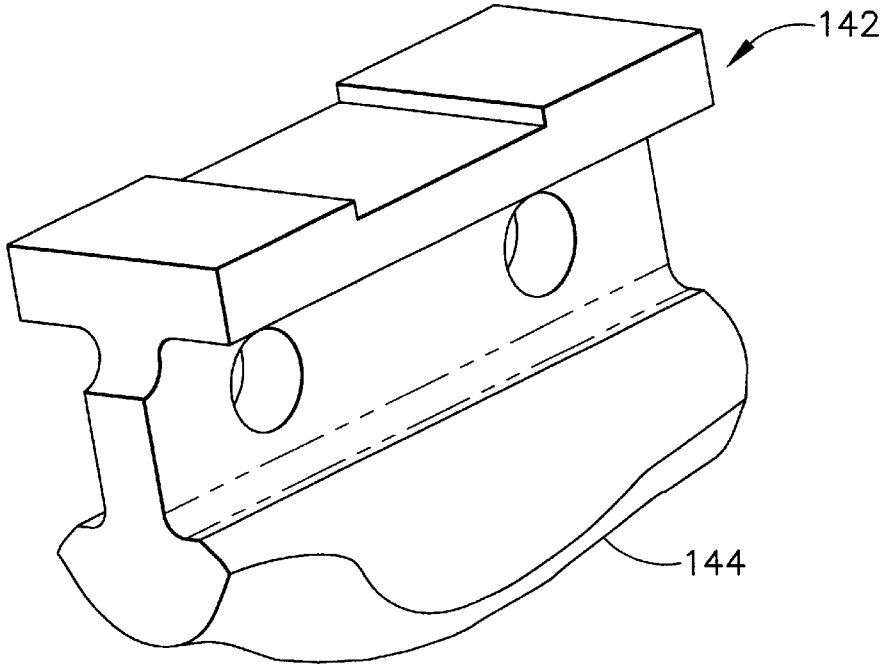
FIG. 11 is a side perspective view of a contoured pin having an alternative configuration, where an upper portion has been deleted for clarity.
Figure 12:
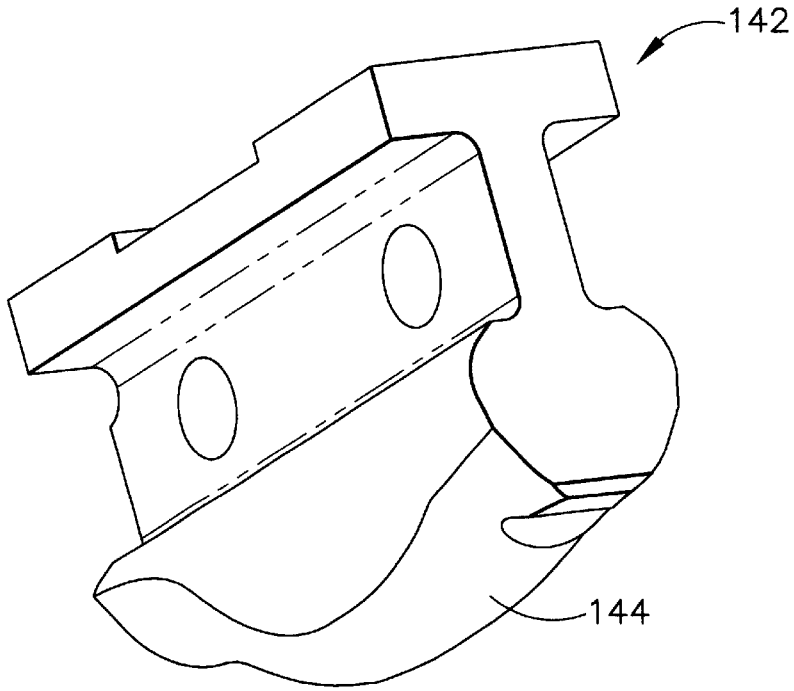
FIG. 12 is a bottom perspective view of the contoured pin having an alternative configuration depicted in FIG. 11, where an upper portion has been deleted for clarity.
Figure 13:
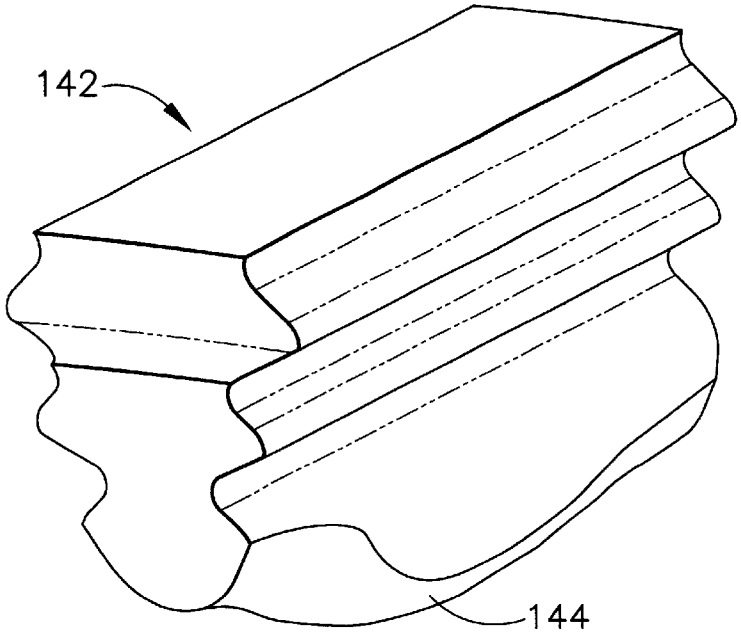
FIG. 13 is a side perspective view of the contoured pin depicted in FIGS. 11 and 12 with an upper portion included thereon; and, FIG. 14 is a bottom perspective view of the contoured pin depicted in FIGS. 11–13 with an upper portion included thereon.
Figure 14:
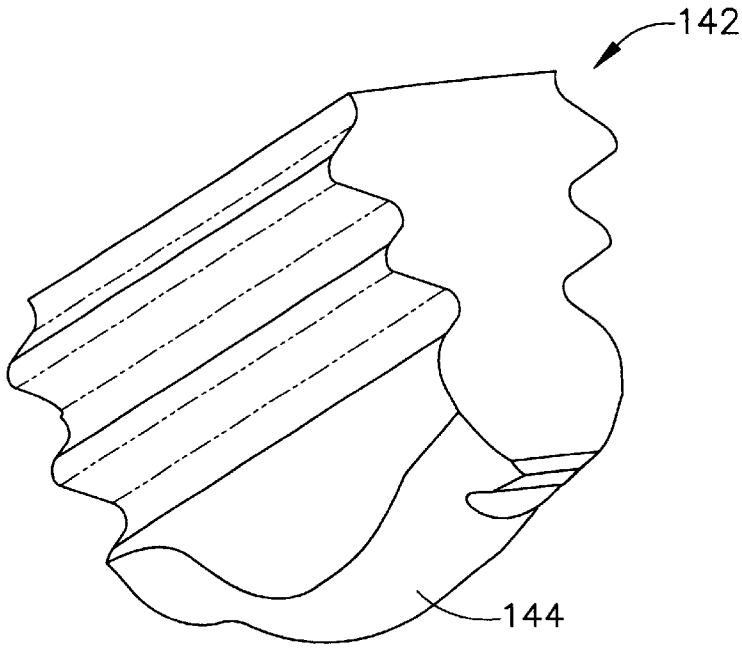

Second portion 76 of pin member 42 has a substantially dovetail shape so that it can be easily inserted into pressure face portion 18 of dovetail slot 14 and pin member 42 retained in position. Thus, a pair of grooved portions 77 and 79 are preferably formed on each side thereof, as are a pair flared portions 81 and 83 interposed therewith. Second portion 76 also forms a seal between pressure face portion 18 and bottom portion 20 of dovetail slot, whereby abrasive media 26 is kept away from pressure surface portion 18. Second portion 76 is generally formed via injection molding and is intended to bond to first portion 74 as shown in FIG. 10. A connector portion (not shown) may also be provided which extends through openings 94 of first portion 74. Second portion 76 is preferably made of a softer material than first portion 74, such as thermal setting plastic, nylon or urethane, providing it has a hardness with a durometer reading on the Shore scale of approximately D50–90. Accordingly, second portion 76 is able to perform its intended retention and sealing functions without scratching or otherwise marring pressure surface portion 18.

It will be noted that second portion 76 may include a step 85 located along a forward portion 60 of top surface 87 so as to conform with a corresponding step 102 in each adjacent post 16 of disk 12. This may also be utilized to confirm that each pin member 42 is properly inserted within dovetail slots 14 during assembly into fixture 10.

It will be appreciated from the foregoing description of abrasive flow fixture 10, pin member 42, and flow path 38 through each dovetail slot 14 that a method of removing a predetermined amount of material from surface 22 of each dovetail slot bottom portion 20 in disk 12 includes the steps of configuring flow path 38 through each dovetail slot 14 and providing a flow of abrasive media 26 through each flow path 38 for a designated number of cycles so that a substantially uniform amount of material is removed from a targeted area of each dovetail slot bottom portion 20. The method further includes the step of sealing pressure surface portion 18 of each dovetail slot 14 from bottom portion 20 to prevent abrasive media 26 from flowing thereagainst. Both functions are accomplished by inserting second portion 76 of pin member 42 into each dovetail slot 14. By having pin member 42 contoured properly, areas of reduced cross-section are provided and a minimum or critical gap 42 is maintained in each flow path 38.

It will be understood that the predetermined amount of material removed from each surface 22 of dovetail slot bottom portion 20 is preferably at least approximately 0.002 inches (2.0 mils), more preferably in a range of approximately 0.002–0.006 inches (2.0–6.0 mils), and optimally in a range of approximately 0.0025–0.0035 inches (2.5–3.5 mils). In order to determine the designated number of cycles required by fixture 10 to remove the predetermined amount of material from each dovetail slot bottom portion, a depth of dovetail slot bottom portion 20, herein referred to as radial height 72, is measured prior to providing abrasive media 26 through flow path 38. After a given number of cycles has been performed by fixture 10, the depth (radial height 72) of dovetail slot bottom portion 20 is again measured. This process is repeated until the predetermined amount of material is removed and the number of cycles required is recorded. Even after the designated number of cycles is performed, it is preferred that confirmation be made that at least the predetermined amount of material has been removed. Dovetail slot bottom portion 20 for each dovetail slot 14 may also be shot peened in order to enhance surface 22 after the process of material removal has occurred.

Having shown and described the preferred embodiment of the present invention, further adaptations of the abrasive flow fixture 10, flow path 38 through dovetail slot bottom portion 20, and/or pin member 42 may be made and still be within the scope of the invention. Moreover, steps in the method of removing a predetermined amount of material from dovetail slot bottom portion 20 may be altered and still perform the intended function.

What is claimed is:

1. A method of removing a predetermined amount of material from a bottom portion of a dovetail slot in a gas turbine engine disk, comprising the following steps:

(a) configuring a designated flow path through said dovetail slot; and, (b) providing a flow of abrasive media through said flow path a designated number of cycles so that a substantially uniform amount of material is removed from said dovetail slot bottom portion.

2. The method of claim 1, further comprising the step of sealing a pressure surface of said dovetail slot to prevent said abrasive media from flowing thereagainst.

3. The method of claim 1, further comprising the step of inserting a pin member into said dovetail slot so as to form areas of reduced cross-section in said flow path.

4. The method of claim 3, wherein said pin member is retained in a pressure face of said dovetail slot.

5. The method of claim 3, further comprising the step of maintaining a minimum gap between a bottom surface of said pin member and a surface of said dovetail slot bottom portion.

6. The method of claim 1, further comprising the step of maintaining a minimum cross-section in said flow path.

7. The method of claim 1, further comprising the step of measuring a depth for said dovetail slot bottom portion prior to providing said abrasive media through said flow path.

8. The method of claim 7, further comprising the step of measuring a depth for said dovetail slot bottom portion after providing said abrasive media through said flow path.

9. The method of claim 1, further comprising the step of determining said designated number of cycles required in order for said predetermined amount of material to be removed from said dovetail slot bottom portion.

10. The method of claim 1, further comprising the step of confirming that at least said predetermined amount of material is removed from said dovetail slot bottom portion.

11. The method of claim 1, further comprising the step of shot peening said dovetail slot bottom portion after said predetermined amount of material is removed therefrom.

12. The method of claim 1, wherein said flow path has a variable cross-section along a longitudinal axis through said dovetail slot.

13. The method of claim 1, wherein said flow path has a variable cross-section in a direction substantially perpendicular to a longitudinal axis through said dovetail slot.

14. The method of claim 1, wherein said predetermined amount of material removed from said dovetail slot bottom portion is at least approximately 2 mils.

15. The method of claim 1, wherein said predetermined amount of material is removed from a targeted area in said dovetail slot bottom portion.

16. An apparatus for removing a predetermined amount of material from a bottom surface of a dovetail slot in a gas turbine engine disk, wherein a longitudinal axis extends through said dovetail slot, comprising:

(a) a fixture for providing a flow of abrasive media back and forth through a designated path at a predetermined pressure and flow rate;

(b) a cradle for retaining said gas turbine engine disk in position so that said dovetail slot is in flow communication with said designated path; and, (c) a device for defining a designated flow path through said dovetail slot for said abrasive media;

wherein said flow of abrasive media removes a substantially uniform amount of material from a bottom surface of said dovetail slot.

17. The apparatus of claim 16, wherein said apparatus seals a pressure face of said dovetail slot from said flow of abrasive media.

18. The apparatus of claim 16, wherein said abrasive media flows through said flow path of said dovetail slot for a designated number of cycles.

19. The apparatus of claim 16, wherein said predetermined amount of material removed from said dovetail slot bottom surface by said abrasive media is at least approximately 2 mils.

20. The apparatus of claim 16, wherein said apparatus provides a minimum cross-section through said designated flow path of said dovetail slot.

21. The apparatus of claim 16, wherein said apparatus provides said designated flow path through said dovetail slot with a variable cross-section along said longitudinal axis of said dovetail slot.

22. The apparatus of claim 16, wherein said apparatus provides said designated flow path through said dovetail slot with a variable cross-section in a direction substantially perpendicular to said longitudinal axis of said dovetail slot.

23. The apparatus of claim 16, wherein designated flow paths through each of said dovetail slots in said disk are in flow communication with said designated path of said abrasive flow fixture so that abrasive media flows therethrough substantially simultaneously.

* * * * *